US008607653B2

(12) United States Patent
Murakami

(10) Patent No.: US 8,607,653 B2
(45) Date of Patent: Dec. 17, 2013

(54) DIE-CAST ARTICLE QUALITY JUDGING METHOD, DIE-CASTING MACHINE SELECTING METHOD, AND DIE-CASTING CONDITION DETERMINING METHOD

(75) Inventor: Masayuki Murakami, Akashi (JP)

(73) Assignee: Toyo Machinery & Metal Co., Ltd., Akashi-shi, Hyogo (JP)

( * ) Notice: Subject to any disclaimer, the term of this patent is extended or adjusted under 35 U.S.C. 154(b) by 664 days.

(21) Appl. No.: 12/741,701

(22) PCT Filed: Oct. 23, 2008

(86) PCT No.: PCT/JP2008/069192

§ 371 (c)(1),
(2), (4) Date: May 6, 2010

(87) PCT Pub. No.: WO2009/084313

PCT Pub. Date: Jul. 9, 2009

(65) Prior Publication Data

US 2010/0263461 A1 Oct. 21, 2010

(30) Foreign Application Priority Data

Dec. 27, 2007 (JP) ..... 2007-336635

(51) Int. Cl.
*G01M 3/04* (2006.01)

(52) U.S. Cl.
USPC ..... 73/865.8

(58) Field of Classification Search
USPC ..... 73/865.8
See application file for complete search history.

(56) References Cited

U.S. PATENT DOCUMENTS 5,455,773 A * 10/1995 Frey ..... 700/146
7,540,317 B2 6/2009 Kubota et al.
7,762,311 B2 7/2010 Kubota et al.
7,967,058 B2 6/2011 Kubota et al.

FOREIGN PATENT DOCUMENTS

JP 5-15411 Y2 4/1993
JP 2006-082134 A 3/2006
TW I263550 B 10/2006

OTHER PUBLICATIONS

Takao Kaneuchi, "Application of PQ2 Diagram and J-Factor to Evaluate Parameters for High-Pressure Die Casting Process", Hitachi Metals Technical Review, 2007, pp. 27-32, vol. 23., Hitachi Metals, Ltd.
International Search Report of PCT/JP2008/069192, mailing date of Jan. 27, 2009.
Taiwanese Office Action dated Jun. 21, 2012, issued in corresponding Taiwanese Patent Application No. 097140064, (4 pages).

* cited by examiner

*Primary Examiner* — Leonard Chang
*Assistant Examiner* — Tamiko Bellamy
(74) *Attorney, Agent, or Firm* — Westerman, Hattori, Daniels & Adrian, LLP

(57) ABSTRACT

The present invention provides: a die-cast quality judging method that can easily judge whether or not a prescribed quality is satisfied; a die-casting machine selecting method of judging whether or not plural prescribed qualities are satisfied; and a die-casting condition determining method of determining die-casting conditions.
It is judged that inequalities to be restricted by judging standard values $Q_{fLB}^2$ and $Q_{aUB}^2$ are not true from the positional relation between a process point 13 that is an intersection of a machine characteristic line 11 and a die characteristic line 12 and straight lines 21, 22, 23, 24, and 25 and thus it is judged that the inequalities to restrict an upper limit of a filling time and a lower limit of an air vent exhaust velocity are not true. That is, it is judged that prescribed qualities are not satisfied with regard to misrun and gas inclusion.

6 Claims, 14 Drawing Sheets

| QUALITY JUDGING PARAMETER | INEQUALITY TO RESTRICT SQUARE VALUE OF MOLTEN METAL FLOW RATE AT ACTUAL CASTING | PRESCRIBED QUALITY SATISFIED WHEN INEQUALITY IS TRUE |
|---|---|---|
| $T_f$ : FILLING TIME | $Q_1^2 \geq Q_{fLB}^2$ | FEW MISRUNS |
| $V_g$ : GATE VELOCITY | $Q_1^2 \geq Q_{gLB}^2$ | FEW NESTS<br>FEW MISRUNS |
| | $Q_1^2 \leq Q_{gUB}^2$ | LOW SEIZING FREQUENCY |
| $V_s$ : FIN FORMING INJECTION VELOCITY | $Q_1^2 \leq Q_{sUB}^2$ | FEW FINS |
| $V_a$ : AIR VENT EXHAUST VELOCITY | $Q_1^2 \leq Q_{aUB}^2$ | FEW NESTS |

FIG. 1

| QUALITY JUDGING PARAMETER | INEQUALITY TO RESTRICT SQUARE VALUE OF MOLTEN METAL FLOW RATE AT ACTUAL CASTING | PRESCRIBED QUALITY SATISFIED WHEN INEQUALITY IS TRUE |
|---|---|---|
| $T_f$ : FILLING TIME | $Q_1^2 \geq Q_{fLB}^2$ | FEW MISRUNS |
| $V_g$ : GATE VELOCITY | $Q_1^2 \geq Q_{gLB}^2$ | FEW NESTS<br>FEW MISRUNS |
| | $Q_1^2 \leq Q_{gUB}^2$ | LOW SEIZING FREQUENCY |
| $V_s$ : FIN FORMING INJECTION VELOCITY | $Q_1^2 \leq Q_{sUB}^2$ | FEW FINS |
| $V_a$ : AIR VENT EXHAUST VELOCITY | $Q_1^2 \leq Q_{aUB}^2$ | FEW NESTS |

FIG. 2

| |
|---|
| $Q_{fLB}^2 = (V_f/T_{fUB})^2$ |
| $Q_{gLB}^2 = (V_{gLB} \times A_g)^2$ |
| $Q_{gUB}^2 = (V_{gUB} \times A_g)^2$ |
| $Q_{sUB}^2 = (V_{sUB} \times A_s)^2$ |
| $Q_{aUB}^2 = (V_{aUB} \times A_a)^2$ |

FIG. 10

| INEQUALITY | MEASURE TAKEN WHEN INEQUALITY IS NOT TRUE |
|---|---|
| $Q_1^2 \geq Q_{fLB}^2$ | TO INCREASE GATE CROSS SECTION $A_g$<br>TO INCREASE SET INJECTION VELOCITY<br>TO INCREASE ACCUMULATOR PRESSURE<br>TO INCREASE SLEEVE CROSS SECTION As |
| $Q_1^2 \geq Q_{gLB}^2$ | TO DECREASE GATE CROSS SECTION $A_g$<br>TO INCREASE SET INJECTION VELOCITY<br>TO INCREASE ACCUMULATOR PRESSURE<br>TO INCREASE SLEEVE CROSS SECTION As |
| $Q_1^2 \leq Q_{gUB}^2$ | TO INCREASE GATE CROSS SECTION $A_g$<br>TO DECREASE SET INJECTION VELOCITY<br>TO DECREASE SLEEVE CROSS SECTION As |
| $Q_1^2 \leq Q_{sUB}^2$ | TO DECREASE ACCUMULATOR PRESSURE $P_{acc}$<br>TO INCREASE SLEEVE CROSS SECTION As<br>TO CHANGE TO MODEL HAVING LARGE RATED MOLD BLOCKING FORCE Fr<br>TO DECREASE SET INJECTION VELOCITY |
| $Q_1^2 \leq Q_{aUB}^2$ | TO INCREASE AIR VENT CROSS SECTION Aa<br>TO DECREASE SET INJECTION VELOCITY<br>TO DECREASE SLEEVE CROSS SECTION As |

FIG. 11

| QUALITY JUDGING PARAMETER | INEQUALITY TO RESTRICT QUALITY JUDGING PARAMETER | PRESCRIBED QUALITY SATISFIED WHEN INEQUALITY IS TRUE |
|---|---|---|
| $T_f$ : FILLING TIME | $T_f \leq T_{fUB}$ ($T_{fUB}$ : UPPER LIMIT OF FILLING TIME) | FEW MISRUNS |
| $V_g$ : GATE VELOCITY | $V_g \geq V_{gLB}$ ($V_{gLB}$ : LOWER LIMIT OF GATE VELOCITY) | FEW NESTS<br>FEW MISRUNS |
| | $V_g \leq V_{gUB}$ ($V_{gUB}$ : UPPER LIMIT OF GATE VELOCITY) | LOW SEIZING FREQUENCY |
| $V_s$ : FIN FORMING INJECTION VELOCITY | $V_s \leq V_{sUB}$ ($V_{sUB}$ : UPPER LIMIT OF INJECTION VELOCITY) | FEW FINS |
| $V_a$ : AIR VENT EXHAUST VELOCITY | $V_a \leq V_{aUB}$ ($V_{aUB}$ : UPPER LIMIT OF AIR VENT VELOCITY) | LOW GAS INCLUSION |

FIG. 12

| |
|---|
| $T_{fUB} = K_f \times R_m^2$ |
| $V_{gLB} = (1064/(D_m \times R_g))^{0.59} \times K_g$ |
| $V_{gUB} =$ FOR EXAMPLE { 60 m/s (CASE OF ALUMINUM); 80 m/s (CASE OF ZINC); 100 m/s (CASE OF MAGNESIUM) } |
| $V_{sUB} = (F_r/A_p - P_{acc} \times A_c/A_s)/(M_i/T_d/A_s + D_h \times V_{ha} \times A_c/A_s)$ |
| $V_{aUB} = 340$ m/s |

FIG. 14

| | |
|---|---|
| $A_a$ | : AIR VENT CROSS SECTION |
| $A_c$ | : INJECTION CYLINDER CROSS SECTION |
| $A_g$ | : GATE CROSS SECTION |
| $A_p$ | : PROJECTION AREA |
| $A_s$ | : SLEEVE CROSS SECTION |
| $C_g$ | : FLOW RATE COEFFICIENT |
| $D_h$ | : HYDRAULIC OIL DENSITY |
| $D_m$ | : MOLTEN METAL DENSITY |
| $F_r$ | : RATED MOLD BLOCKING FORCE |
| $K_f$ | : MATERIAL COEFFICIENT |
| $K_g$ | : MATERIAL COEFFICIENT |
| $M_i$ | : PLUNGER MASS |
| $P_{acc}$ | : ACCUMULATOR PRESSURE |
| $R_g$ | : GATE THICKNESS |
| $T_d$ | : TIME FROM BEGINNING OF INJECTION DECELERATION TO INJECTION STOP |
| $V_f$ | : FILLING VOLUME |
| $V_{ha}$ | : SOUND VELOCITY IN HYDRAULIC OIL |
| $V_{s0}$ | : INJECTION VELOCITY AT BLANKING |

DIE-CAST ARTICLE QUALITY JUDGING METHOD, DIE-CASTING MACHINE SELECTING METHOD, AND DIE-CASTING CONDITION DETERMINING METHOD

FIELD OF THE INVENTION

The present invention relates to: a die-cast quality judging method of judging whether or not a die-casting product cast under set die-casting conditions satisfies a prescribed quality; a die-casting machine selecting method of judging whether or not plural prescribed qualities are satisfied; and a die-casting condition determining method of determining die-casting conditions.

BACKGROUND ART

Die-casting prevails widely as a technology for casting a product at a high speed with a high degree of accuracy. Then plural products are assorted in accordance with mold locking force by a die-casting machine maker.

When you buy a new die-casting machine or when you cast a new product with an already bought die-casting machine, you need to judge whether or not it is possible to cast a die-casting product of prescribed quality. Here, a die-cast quality is judged by nests, fins, cold folds, and cold shut for example. In general, a larger machine is more likely to satisfy a prescribed quality but the price increases. Hence it is important to select a machine that satisfies a prescribed quality and is less expensive.

Whether or not a prescribed quality is satisfied is judged through the following procedure. Firstly, the conditions of a die-casting machine, a die assembly, and molten metal are set. The conditions are collectively called die-casting conditions (casting methods). Successively, under the die-casting conditions, a value of a parameter used for quality judgment (called a "quality judging parameter") is compared with a judging standard value functioning as a standard for judging whether or not a prescribed quality is satisfied and thereby whether or not the prescribed quality is satisfied is judged. The procedure is hereunder explained more specifically.

FIG. 11 is a table showing quality judging parameters, inequalities to restrict the quality judging parameters, and prescribed qualities satisfied when the inequalities are true. The inequalities are formed so that the quality judging parameters (the left-hand sides of the inequalities) may be restricted by the judging standard values (the right-hand sides of the inequalities) functioning as the standards for judging whether or not the prescribed qualities are satisfied. Then, when the inequalities are true, the prescribed qualities are satisfied. FIG. 12 is a table showing the expressions to obtain the judging standard values. Here, the meanings of the symbols are shown in FIG. 14. Then the symbols are known widely and thus the explanations thereof are omitted.

Explanations are made on the basis of the case where a filling time ($T_f$) is adopted as an example of the quality judging parameters. In this case, the judging standard value is $T_{fUB}$ (the upper limit of the filling time). When the inequality ($T_f \leq T_{fUB}$) to restrict the quality judging parameter ($T_f$) by the judging standard value ($T_{fUB}$) is true, it is judged that the prescribed quality of "few misruns" is satisfied. Here, the judging standard value $T_{fUB}$ is obtained from the expression $T_{fUB}=K_f \times R_m^2$ as shown in the table of FIG. 12. Here, $K_f$ and $R_m$ represent a material coefficient and a product thickness respectively (refer to FIG. 14).

The selection of a die-casting machine is carried out by judging the qualities of plural quality judging parameters as stated above and evaluating whether or not a cast die-casting product satisfies the plural prescribed qualities. When the selection of a die-casting machine is carried out and even one of the quality judging parameters not satisfying a prescribed quality exists, it is judged that it is impossible to cast a product of the prescribed qualities. On this occasion, the die-casting conditions are changed and the selection of a die-casting machine is carried out again. The change of the die-casting conditions and the selection of a die-casting machine are repeated until all the quality judging parameters satisfy all the prescribed qualities and finally die-casting conditions satisfying all the prescribed qualities are obtained.

Meanwhile, in quality judgment, it is sometimes necessary to use a value of molten metal filling pressure and a square value of a molten metal flow rate at actual casting. On this occasion, a P-$Q^2$ diagram (refer to Non-patent Documents 1 and 2) is used in many cases. The P-$Q^2$ diagram is explained hereunder.

FIG. 13 is a graph showing an example of the P-$Q^2$ diagram. In the P-$Q^2$ diagram (1), a machine characteristic line 11 and a die characteristic line 12 are drawn on a two-dimensional coordinate plane expressing a molten metal filling pressure (P) on the vertical axis 51 and a square of a molten metal flow rate ($Q^2$) on the horizontal axis 52. The machine characteristic line 11 is a straight line showing the casting capability of a die-casting machine used and is represented by the expression $P=P_O \times (1-Q^2/Q_O^2)$. Here, $P_O$ and $Q_O$ are represented by the expressions $P_O=P_{acc} \times A_c/A_s$ and $Q_O=V_{sO} \times A_s$ respectively and $P_{acc}$ represents an accumulator pressure, $V_{sO}$ an injection velocity at blanking, $A_c$ an injection cylinder cross section, and $A_s$ a sleeve cross section. The die characteristic line 12 is a characteristic line intrinsic to a die assembly and is represented by the expression $P=B \times Q^2$. Here, B is represented by the expression $B=D_m/(2 \times A_g^2 \times C_g^2)$ and $D_m$ represents a molten metal density, $A_g$ a gate cross section, and $C_g$ a flow rate coefficient.

In the P-$Q^2$ diagram (1), the intersection 13 of the machine characteristic line 11 and the die characteristic line 12 is called a "process point". The coordinate value $Q_1^2$ of the process point 13 on the horizontal axis is the square value of a molten metal flow rate at actual casting and the coordinate value $P_1$ on the vertical axis is a molten metal filling pressure at the actual casting.

Non-patent Document 3 discloses a method for determining die-casting conditions by judging whether or not a process point exists within a process window in a P-$Q^2$ diagram and judging whether or not a J-Factor is in a prescribed range. It is possible to determine die-casting conditions by repeating the selection of a die-casting machine and the change of die-casting conditions until prescribed qualities are satisfied.

Non-patent Document 1: "Encyclopedia of Die-casting" supervised by 50th Anniversary Editorial Committee of Japan Diecasting Association, published by Keikinzoku Tsushin AL Co., Ltd., 2005, p. 356-357

Non-patent Document 2: "Aluminum Alloy Die-Casting—The Technology and Troubleshooting" authored by Tomonobu Sugano and Torazou Uehara, published by Kallos Publishing Co., Ltd., 1988, P. 138-143

Non-patent Document 3: "Application of $PQ^2$ Diagram and J-Factor to Evaluate Parameters for High-Pressure Die Casting Process" authored by Yoshio Kaneuchi, Hitachi Metals Technical Review, published by Hitachi Metals, Ltd., 2007, Vol. 23, p. 27-32

DISCLOSURE OF THE INVENTION

Problems to be Solved by the Invention

A P-$Q^2$ diagram and a graph of a J-Factor are used in the method described in Non-patent Document 3. A problem of the method using such plural graphs has been that it is necessary to refer to plural graphs in order to grasp characteristics and the method is very burdensome.

Further, by the method described in Non-patent Document 3, it is necessary to judge the change of the process point of a P-$Q^2$ diagram in a two-dimensional region (a process window) and hence a problem has been that it is necessary to confirm the values on both the vertical and horizontal axes and the method is very burdensome.

The present invention has been established in view of the above problems and an object of the present invention is to provide: a die-cast quality judging method that can easily judge whether or not a prescribed quality is satisfied; a die-casting machine selecting method of judging whether or not plural prescribed qualities are satisfied by using the die-cast quality judging method; and a die-casting condition determining method of determining die-casting conditions.

Means for Solving the Problems

The die-cast quality judging method according to Aspect 1 is a die-cast quality judging method of judging whether or not a die-casting product cast under set die-casting conditions satisfies a prescribed quality on the basis of whether or not an inequality to restrict the value of a quality judging parameter by a judging standard value functioning as a standard for judging whether or not the prescribed quality is satisfied is true; and is characterized in that whether or not the prescribed quality is satisfied is judged on the basis of whether or not an inequality modified from the inequality so as to restrict a square value of a molten metal flow rate at actual casting by a judging standard value is true.

By the die-cast quality judging method according to Aspect 1, an inequality to restrict the value of a quality judging parameter by a judging standard value is modified to an inequality to restrict the square value of a molten metal flow rate at actual casting by a judging standard value and whether or not a prescribed quality is satisfied is judged on the basis of whether or not the modified inequality is true.

Explanations are made more specifically. Here, an inequality $Z \geq Z_B$ to restrict a value of a quality judging parameter Z by a judging standard value $Z_B$ is given. When the quality judging parameter Z is represented by the expression $Z=F(Q_1)$ by using a function F (here, F is a bijection) of a molten metal flow rate $Q_1$ at actual casting, the inequality to restrict the quality judging parameter becomes the expression $F(Q_1) \geq Z_3$. The inequality is modified to an inequality ($Q_1^2 \geq Q_B^2$ or $Q_1^2 \leq Q_B^2$) to restrict $Q_1^2$. Here, $Q_B^2$ is a judging standard value to restrict $Q_1^2$ in the modified inequality. Here, the orientation of the inequality sign in the modified inequality is determined by the function F.

Meanwhile, it is obvious that the similar modification can be applied also in the case where an inequality to restrict a value of a quality judging parameter Z by a judging standard value $Z_B$ is the expression $Z \leq Z_B$ (the case where the inequality sign is reversed from the above case) and hence the explanations are omitted. The modified inequality is the same restricting expression as the inequality before modification and hence it is possible to judge whether or not a prescribed quality is satisfied on the basis of whether or not the modified inequality is true.

The die-cast quality judging method according to Aspect 2 is characterized in that, in Aspect 1 the quality judging parameter is a filling time; and, when an inequality to restrict a value of the filling time by a judging standard value functioning as a standard for judging whether or not the prescribed quality is satisfied is given, a value obtained by dividing a filling volume in the set die-casting conditions by the judging standard value to restrict the value of the filling time and squaring the divided value is used as a judging standard value to restrict the square value of a molten metal flow rate at actual casting in the modified inequality.

By the die-cast quality judging method according to Aspect 2, an inequality to restrict a filling time is modified to an inequality to restrict the square value of a molten metal flow rate at actual casting by a judging standard value and whether or not a prescribed quality is satisfied is judged on the basis of whether or not the modified inequality is true.

Explanations are made more specifically. Here, an inequality $T_f \leq T_{fUB}$ to restrict a value of a filling time $T_f$ by a judging standard value $T_{fUB}$ is given. Since the filling time $T_f$ is represented by the expression $T_f=V_f/Q_1$ by using a molten metal flow rate $Q_1$ at actual casting and a filling volume $V_f$, the above inequality becomes $V_f/Q_1 \leq T_{fUB}$ and can be modified to $Q_1^2 \geq Q_{fLB}^2$. Here, $Q_{fLB}^2$ is represented by the expression $Q_{fLB}^2=(V_f/T_{fUB})^2$. The modified inequality $Q_1^2 \geq Q_{fLB}^2$ is the same restricting expression as the inequality $T_f \leq T_{fUB}$ before modification and hence it is possible to judge whether or not a prescribed quality is satisfied on the basis of whether or not the modified inequality is true.

The die-cast quality judging method according to Aspect 3 is characterized in that, in Aspect 1 the quality judging parameter is a gate velocity; and, when an inequality to restrict a value of the gate velocity by a judging standard value functioning as a standard for judging whether or not the prescribed quality is satisfied is given, a value obtained by multiplying the judging standard value to restrict the value of the gate velocity by a gate cross section in the set die-casting conditions and squaring the multiplied value is used as a judging standard value to restrict the square value of a molten metal flow rate at actual casting in the modified inequality.

By the die-cast quality judging method according to Aspect 3, an inequality to restrict a gate velocity is modified to an inequality to restrict the square value of a molten metal flow rate at actual casting by a judging standard value and whether or not a prescribed quality is satisfied is judged on the basis of whether or not the modified inequality is true.

Explanations are made more specifically. Here, an inequality $V_g \geq V_{gLB}$ to restrict a value of a gate velocity $V_g$ by a judging standard value $V_{gLB}$ is given. Since the gate velocity $V_g$ is represented by the expression $V_g=Q_1/A_g$ by using a molten metal flow rate $Q_1$ at actual casting and a gate cross section $A_g$, the above inequality becomes $Q_1/A_g \geq V_{gLB}$ and can be modified to $Q_1^2 \geq Q_{gLB}^2$. Here, $Q_{gLB}^2$ is represented by the expression $Q_{gLB}^2=(V_{gLB} \times A_g)^2$. The modified inequality $Q_1^2 \geq Q_{gLB}^2$ is the same restricting expression as the inequality $V_g \geq V_{gLB}$ before modification and hence it is possible to judge whether or not a prescribed quality is satisfied on the basis of whether or not the modified inequality is true.

Further, when the inequality sign is reversed, it is also possible to make judgment likewise. Here, an inequality $V_g \leq V_{gUB}$ to restrict a value of a gate velocity $V_g$ by a judging standard value $V_{gUB}$ is given. Since the gate velocity $V_g$ is represented by the expression $V_g=Q_2/A_g$ by using a molten metal flow rate $Q_1$ at actual casting and a gate cross section $A_g$, the above inequality becomes $Q_1/A_g \leq V_{gUB}$ and can be modified to $Q_1^2 \leq Q_{gUB}^2$. Here, $Q_{gUB}^2$ is represented by the expression $Q_{gUB}^2$ $(V_{gUB} \times A_g)^2$. The modified inequality $Q_1^2 \leq Q_{gUB}^2$ is the same restricting expression as the inequality $V_g \leq V_{gUB}$ before modification and hence it is possible to judge whether or not a prescribed quality is satisfied on the basis of whether or not the modified inequality is true.

The die-cast quality judging method according to Aspect 4 is characterized in that, in Aspect 1 the quality judging parameter is a fin forming injection velocity; and, when an inequality to restrict a value of the fin forming injection velocity by a judging standard value functioning as a standard for judging whether or not the prescribed quality is satisfied is given, a value obtained by multiplying the judging standard value to restrict the value of the injection velocity by a sleeve cross section in the set die-casting conditions and squaring the multiplied value is used as a judging standard value to restrict the square value of a molten metal flow rate at actual casting in the modified inequality.

By the die-cast quality judging method according to Aspect 4, an inequality to restrict a fin forming injection velocity that is an injection velocity at which fins begin to be generated is modified to an inequality to restrict the square value of a molten metal flow rate at actual casting by a judging standard value and whether or not a prescribed quality is satisfied is judged on the basis of whether or not the modified inequality is true.

Explanations are made more specifically. Here, an inequality $V_s \leq V_{sUB}$ to restrict a value of a fin forming injection velocity $V_s$ by a judging standard value $V_{sUB}$ is given. Since the injection velocity $V_s$ is represented by the expression $V_s = Q_1/A_s$ by using a molten metal flow rate $Q_1$ at actual casting and a sleeve cross section $A_s$, the above inequality becomes $Q_1/A_s \leq V_{sUB}$ and can be modified to $Q_1^2 \leq Q_{sUB}^2$. Here, $Q_{sUB}^2$ is represented by the expression $Q_{sUB}^2 = (V_{sUB} \times A_s)^2$. The modified inequality $Q_1^2 \leq Q_{sUB}^2$ is the same restricting expression as the inequality $V_s \leq V_{sUB}$ before modification and hence it is possible to judge whether or not a prescribed quality is satisfied on the basis of whether or not the modified inequality is true.

The die-cast quality judging method according to Aspect 5 is characterized in that, in Aspect 1 the quality judging parameter is an air vent exhaust velocity; and, when an inequality to restrict a value of the air vent exhaust velocity by a judging standard value functioning as a standard for judging whether or not the prescribed quality is satisfied is given, a value obtained by multiplying the judging standard value to restrict the value of the air vent exhaust velocity by an air vent cross section in the set die-casting conditions and squaring the multiplied value is used as a judging standard value to restrict the square value of a molten metal flow rate at actual casting in the modified inequality.

By the die-cast quality judging method according to Aspect 5, an inequality to restrict an air vent exhaust velocity that is a velocity at which a gas is ejected from an air vent is modified to an inequality to restrict the square value of a molten metal flow rate at actual casting by a judging standard value and whether or not a prescribed quality is satisfied is judged on the basis of whether or not the modified inequality is true.

Explanations are made more specifically. Here, an inequality $V_a \leq V_{aUB}$ to restrict a value of an air vent exhaust velocity $V_a$ by a judging standard value $V_{aUB}$ is given. Since the air vent exhaust velocity $V_a$ is represented by the expression $V_a = Q_1/A_a$ by using a molten metal flow rate $Q_1$ at actual casting and an air vent cross section $A_a$, the above inequality becomes $Q_1/A_a \leq V_{aUB}$ and can be modified to $Q_1^2 \leq Q_{aUB}^2$. Here, $Q_{aUB}^2$ is represented by the expression $Q_{aUB}^2 = (V_{aUB} \times A_a)^2$. The modified inequality $Q_1^2 \leq Q_{aUB}^2$ is the same restricting expression as the inequality $V_a \leq V_{aUB}$ before modification and hence it is possible to judge whether or not a prescribed quality is satisfied on the basis of whether or not the modified inequality is true.

The die-cast quality judging method according to Aspect 6 is characterized in that, in any one of Aspects 1 to 5, the coordinate value on the horizontal axis of a process point that is an intersection of a machine characteristic line and a die characteristic line in a P-$Q^2$ diagram under the set die-casting conditions is set so as to be the square value of a molten metal flow rate at the actual casting.

By the die-cast quality judging method according to Aspect 6, a P-$Q^2$ diagram is drawn under the set die-casting conditions and the coordinate value on the horizontal axis of a process point that is the intersection of a machine characteristic line and a die characteristic line is obtained as the square value of a molten metal flow rate at actual casting.

The die-cast quality judging method according to Aspect 7 is characterized in that, in any one of Aspects 1 to 5 a straight line representing a judging standard value to restrict the square value of a molten metal flow rate at actual casting in the modified inequality is drawn in a P-$Q^2$ diagram under the set die-casting conditions; two divided regions are formed in the P-$Q^2$ diagram by using the straight line representing the judging standard value as a border line; and whether or not the prescribed quality is satisfied is judged on the basis of the region in which the process point that is the intersection of a machine characteristic line and a die characteristic line in the P-$Q^2$ diagram is located.

By the die-cast quality judging method according to Aspect 7, whether or not a prescribed quality is satisfied is judged by visually judging the magnitude relation between the coordinate value of a process point on the horizontal axis (namely, the square value of a molten metal flow rate at actual casting) and a judging standard value of the modified inequality in a P-$Q^2$ diagram.

Explanations are made more specifically. FIGS. 3 and 4 are graphs formed by drawing straight lines showing judging standard values in P-$Q^2$ diagrams respectively. Here, the symbols 11 and 12 are a machine characteristic line and a die characteristic line respectively and the coordinate value on the horizontal axis of a process point 13 that is the intersection is the square value $Q_1^2$ of a molten metal flow rate at actual casting. Further, the symbol 20 represents a straight line showing a judging standard value $Q_B^2$ in a modified inequality.

In the case where the modified inequality is represented by the expression $Q_1^2 \geq Q_B^2$, when the process point 13 is in the region on the right side of the straight line 20 as shown in FIG. 3, the modified inequality is true and hence it is judged that a prescribed quality is satisfied and, when the process point 13 is in the region on the left side of the straight line 20 as shown in FIG. 4, the modified inequality is not true and hence it is judged that a prescribed quality is not satisfied. On the other hand, in the case where the modified inequality is represented by the expression $Q_1^2 \leq Q_B^2$, when the process point 13 is in the region on the right side of the straight line 20 as shown in FIG. 3, the modified inequality is not true and hence it is judged that a prescribed quality is not satisfied and, when the process point 13 is in the region on the left side of the straight line 20 as shown in FIG. 4, the modified inequality is true and hence it is judged that a prescribed quality is satisfied.

A die-casting machine selecting method according to Aspect 8 is characterized in that, with regard to each of plural quality judging parameters, whether or not a prescribed quality is satisfied is judged by using the die-cast quality judging method according to any one of Aspects 1 to 7.

By the die-casting machine selecting method according to Aspect 8, all the inequalities to restrict values of quality judging parameters are modified to inequalities to restrict the square value $Q_1^2$ of a molten metal flow rate at actual casting and whether or not prescribed qualities are satisfied is judged on the basis of whether or not the modified inequalities are true.

The die-casting machine selecting method according to Aspect 9 is a die-casting machine selecting method of judging whether or not the prescribed quality is satisfied by using the die-cast quality judging method according to Aspect 7 with regard to each of plural quality judging parameters; and is characterized in that straight lines representing judging standard values to restrict the square value of a molten metal flow rate at actual casting in all the modified inequalities are drawn in an identical P-$Q^2$ diagram.

By the die-casting machine selecting method according to Aspect 9, all the straight lines showing judging standard values in modified inequalities are drawn in an identical P-$Q^2$ diagram and whether or not prescribed qualities are satisfied is judged respectively.

A die-casting condition determining method according to Aspect 10 is characterized in that, with regard to the plural quality judging parameters, when a quality judging parameter not satisfying the prescribed quality exists as a result of judging whether or not the prescribed qualities are satisfied by using the die-casting machine selecting method according to Aspect claim 8 or 9, the set die-casting conditions are changed.

By the die-casting condition determining method according to Aspect 10, die-casting conditions are changed when a quality judging parameter not satisfying a prescribed quality exists and hence, by repeating the procedure, it is possible to obtain die-casting conditions satisfying all prescribed qualities.

Effects of the Invention

By the present invention, whether or not a prescribed quality is satisfied is judged on the basis of whether or not an inequality to restrict the square value of a molten metal flow rate at actual casting by a judging standard value, in place of an inequality to restrict a quality judging parameter by a judging standard value, is true. That is, it is possible to judge whether or not a prescribed quality is satisfied by using the square value of a molten metal flow rate that is generally used for selecting a die-casting machine.

Further, by the present invention, whether or not a prescribed quality is satisfied is judged on the basis of whether or not an inequality to restrict the square value of a molten metal flow rate at actual casting by a judging standard value, in place of an inequality to restrict a filling time by a judging standard value, is true. That is, it is possible to judge whether or not a prescribed quality stipulated by a filling time is satisfied by using the square value of a molten metal flow rate that is generally used for selecting a die-casting machine.

Further, according to the present invention, whether or not a prescribed quality is satisfied is judged on the basis of whether or not an inequality to restrict the square value of a molten metal flow rate at actual casting by a judging standard value, in place of an inequality to restrict a gate velocity by a judging standard value, is true. That is, it is possible to judge whether or not a prescribed quality stipulated by a gate velocity is satisfied by using the square value of a molten metal flow rate that is generally used for selecting and evaluating a die-casting machine.

Further, by the present invention, whether or not a prescribed quality is satisfied is judged on the basis of whether or not an inequality to restrict the square value of a molten metal flow rate at actual casting by a judging standard value, in place of an inequality to restrict a fin forming injection velocity by a judging standard value, is true. That is, it is possible to judge whether or not a prescribed quality stipulated by an injection velocity is satisfied by using the square value of a molten metal flow rate that is generally used for selecting a die-casting machine.

Further, by the present invention, whether or not a prescribed quality is satisfied is judged on the basis of whether or not an inequality to restrict the square value of a molten metal flow rate at actual casting by a judging standard value, in place of an inequality to restrict an air vent exhaust velocity by a judging standard value, is true. That is, it is possible to judge whether or not a prescribed quality stipulated by an air vent exhaust velocity is satisfied by using the square value of a molten metal flow rate that is generally used for selecting a die-casting machine.

Further, by the present invention, since a P-$Q^2$ diagram is drawn under the set die-casting conditions and the coordinate value on the horizontal axis of a process point that is the intersection of a machine characteristic line and a die characteristic line is obtained as the square value of a molten metal flow rate at actual casting, it is possible to easily obtain the square value of a molten metal flow rate at actual casting. Further, since it is possible to easily obtain the square value of a molten metal flow rate at actual casting, it is possible to easily judge whether or not an inequality to restrict the square value of a molten metal flow rate at actual casting by a judging standard value is true and whether or not a prescribed quality is satisfied.

Further, by the present invention, since whether or not a prescribed quality is satisfied is judged by visually judging the magnitude relation between the coordinate value on the horizontal axis of a process point that is the intersection of a machine characteristic line and a die characteristic line (namely, the square value of a molten metal flow rate at actual casting) and the judging standard value of a modified inequality in a P-$Q^2$ diagram, it is necessary to pay attention only to relation on the horizontal axis (namely, only to one-dimensional relation) in the P-$Q^2$ diagram and it is possible to easily make the judgment.

Further, by the present invention, since all the inequalities to restrict values of quality judging parameters are modified to inequalities to restrict the square value $Q_1^2$ of a molten metal flow rate at actual casting and whether or not prescribed qualities are satisfied is judged on the basis of whether or not the modified inequalities are true, all the prescribed qualities are judged by using the square value $Q_1^2$ of a molten metal flow rate at actual casting and thus it is possible to easily judge whether or not the prescribed qualities are satisfied. This is because, whereas it has heretofore been necessary to obtain all the values of quality judging parameters (for example, a filling time, a gate velocity, a fin forming injection velocity, an air vent exhaust velocity, and others) in addition to judging standard values in the case of judging the inequalities that are not modified and use the values of the quality judging parameters as they are, according to the present invention, it is necessary only to obtain the square value $Q_1^2$ of a molten metal flow rate at actual casting in addition to judging standard values and it is possible to reduce the number of the values to be obtained into nearly half.

Further, according to the present invention, since all the straight lines are drawn in a single P-$Q^2$ diagram, it is not necessary to refer to plural figures but necessary to refer to a single P-$Q^2$ diagram at judgment and thus it is possible to make judgment easily.

Further, by the present invention, since die-casting conditions satisfying all the prescribed qualities can be obtained by repeating the judgment on whether or not an inequality is true and the change of die-casting conditions, it is possible to determine the die-casting conditions easily.

BRIEF DESCRIPTION OF THE DRAWINGS

FIG. 1 is a table showing quality parameters, inequalities to restrict the square value of a molten metal flow rate at actual casting corresponding to the quality parameters, and prescribed qualities satisfied when the inequalities are true in Embodiments 1 to 3 according to the present invention.

FIG. 2 is a table showing expressions to obtain judging standard values in Embodiments 1 to 3 according to the present invention.

FIG. 10 is a table showing the relation between inequalities and measures taken when the inequalities are not true in a die-casting condition determining method in Embodiment 3 according to the present invention.

FIG. 11 is a table showing quality judging parameters, inequalities to restrict the quality judging parameters, and prescribed qualities satisfied when the inequalities are true.

FIG. 12 is a table showing expressions to obtain judging standard values.

FIG. 14 is a table explaining symbols.

EXPLANATION OF REFERENCE NUMERALS AND SYMBOLS

Figure 3:
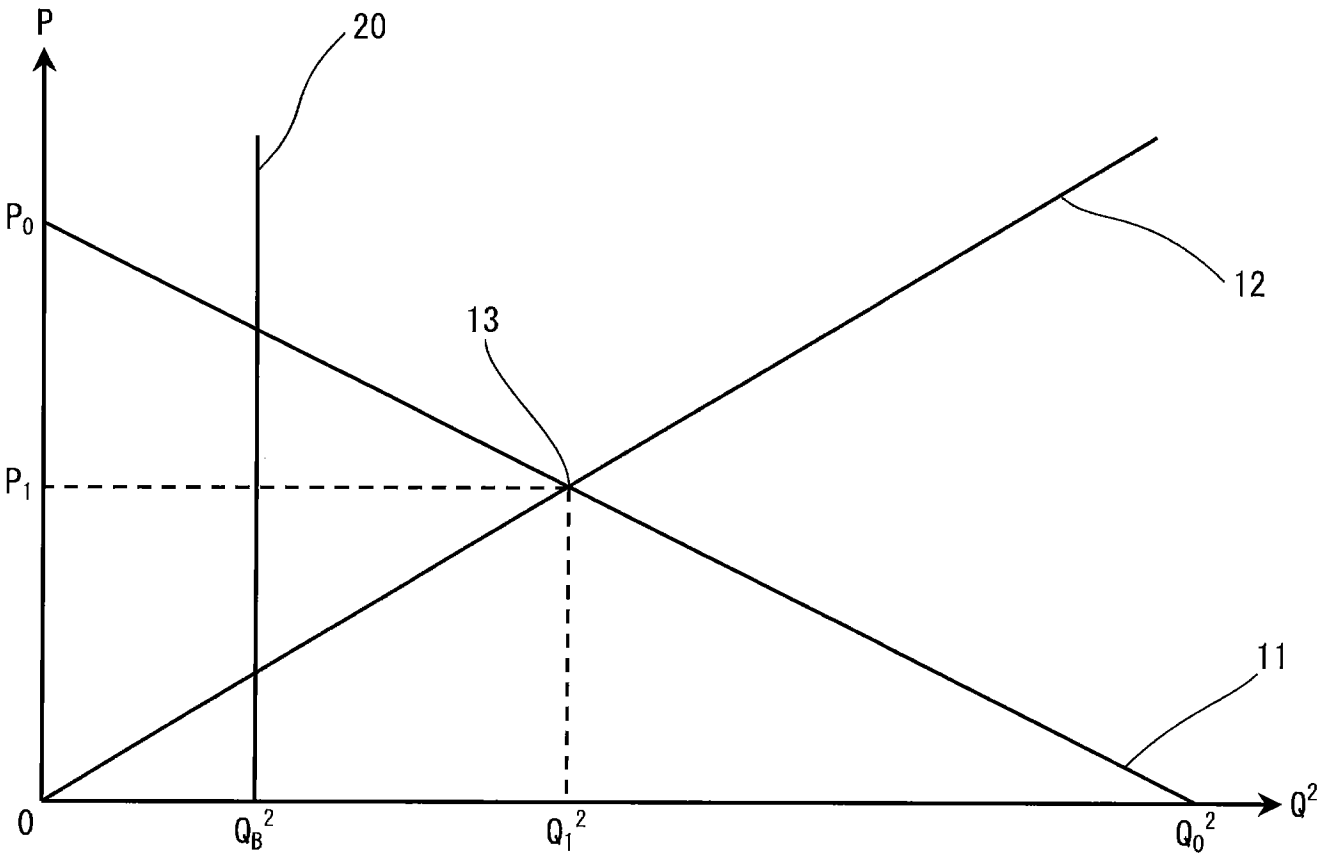
FIG. 3 is a P-$Q^2$ diagram according to the present invention.
Figure 4:
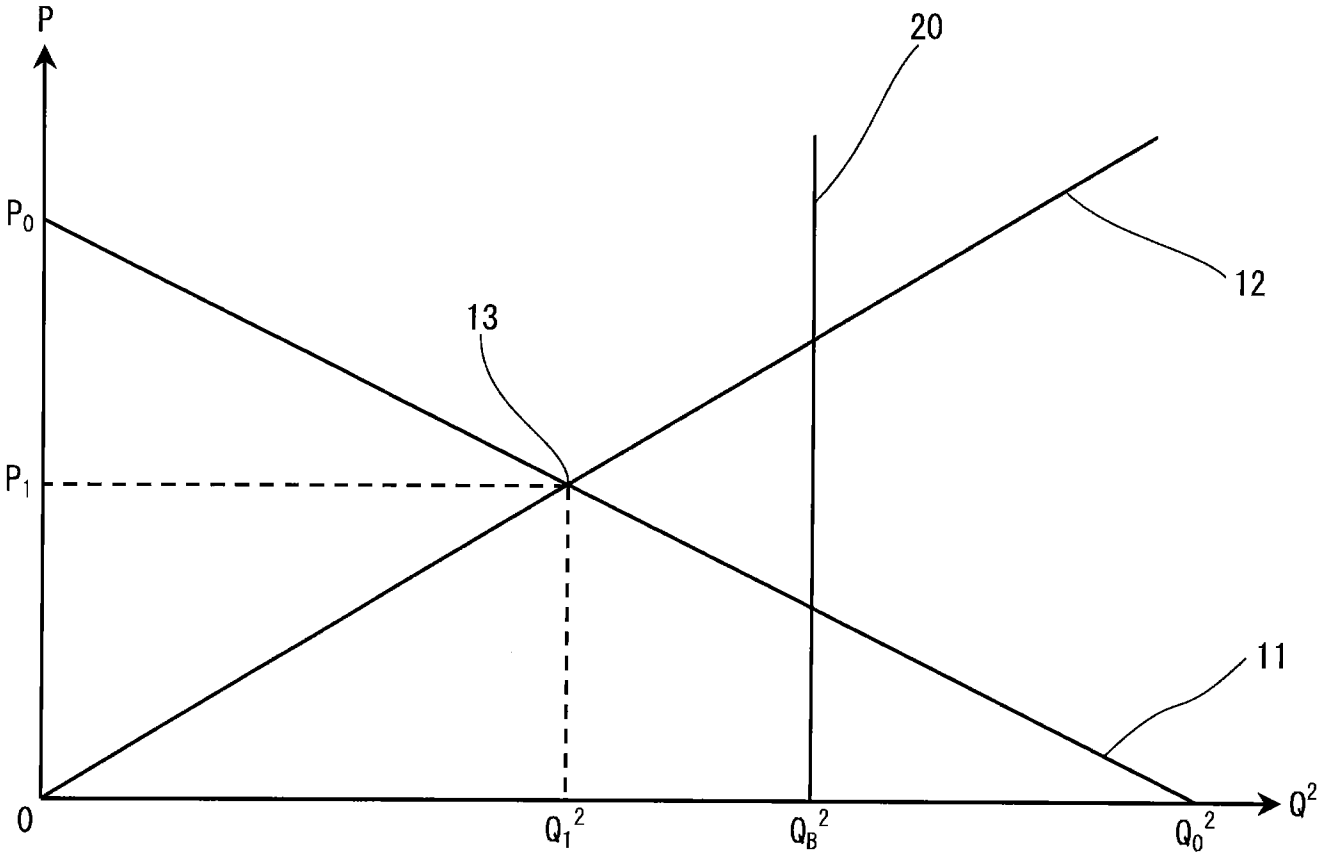
FIG. 4 is a P-$Q^2$ diagram according to the present invention.

1 P-$Q^2$ diagram
11 Machine characteristic line
12 Die characteristic line
13 Process point
20 Straight line representing judging standard value $Q_B^2$
21 Straight line representing judging standard value $Q_{fLB}^2$
22 Straight line representing judging standard value $Q_{gLB}^2$
23 Straight line representing judging standard value $Q_{gUB}^2$
24 Straight line representing judging standard value $Q_{sUB}^2$
25 Straight line representing judging standard value $Q_{aUB}^2$
51 Vertical axis
52 Horizontal axis

BEST MODE FOR CARRYING OUT THE INVENTION

Embodiments according to the present invention are explained in reference to drawings. Here, the embodiments below are only concrete examples of the present invention and the present invention is not limited to the embodiments below.

Embodiment 1

Figure 7:
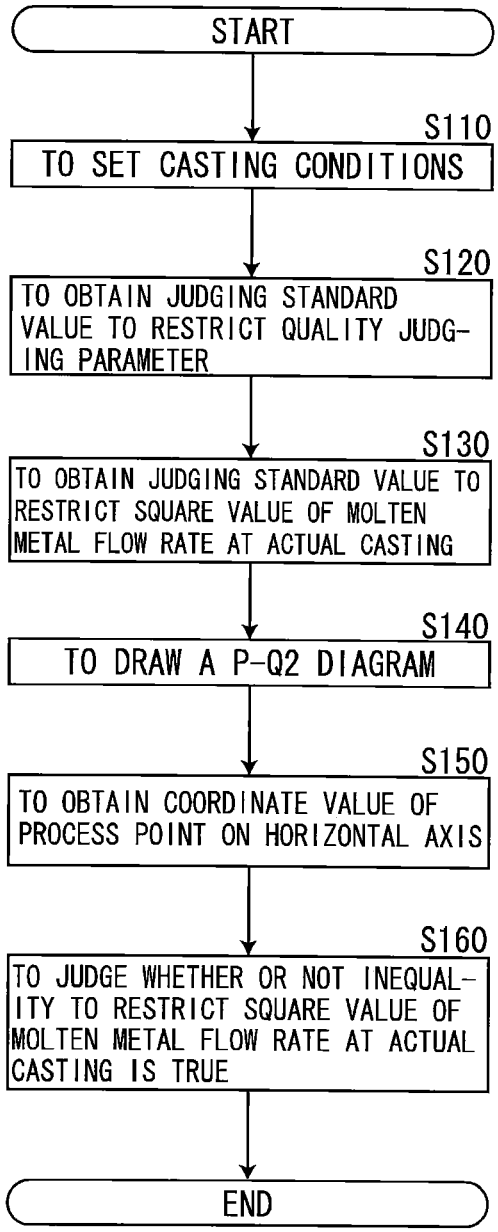
FIG. 7 is a flowchart showing the process flow of a die-cast evaluation method in Embodiment 1 according to the present invention.

FIG. 7 is a flowchart showing the process flow of the present embodiment. Firstly at Step S110, die-casting conditions (casting methods) are set up and thereafter the processing proceeds to Step S120. FIG. 11 is a table showing die-casting conditions. Each of the values is set up as shown in the table.

At Step S120, judging standard values to restrict quality judging parameters are obtained and the processing proceeds to Step S130. FIG. 11 is a table showing quality judging parameters, inequalities to restrict the quality judging parameters, and prescribed qualities satisfied when the inequalities are true. The quality judging parameters are shown in the left column of the table and a filling time, a gate velocity, a fin forming injection velocity that is an injection velocity at which fins begin to be generated, and an air vent exhaust velocity that is a velocity at which a gas is ejected from an air vent are used in the present embodiment. The inequalities to restrict the quality judging parameters are shown in the center column and an inequality to restrict the upper limit of the filling time, an inequality to restrict the lower limit of the gate velocity, an inequality to restrict the upper limit of the gate velocity, an inequality to restrict the upper limit of the fin forming injection velocity, and an inequality to restrict the upper limit of the air vent exhaust velocity are used in the present embodiment. The right-hand sides of the inequalities represent the judging standard values respectively. The prescribed qualities satisfied when the inequalities shown in the center column are true are shown in the right column respectively.

FIG. 12 is a table showing the expressions to obtain the upper limits and the lower limit (namely, judging standard values to restrict the quality judging parameters) in the center column of the table shown in FIG. 11. The judging standard values to restrict the quality judging parameters are obtained by using the expressions shown in the table.

At Step S130, judging standard values to restrict the square value of a molten metal flow rate at actual casting are obtained and the processing proceeds to Step S140. FIG. 1 is a table showing the quality parameters, inequalities to restrict the square value of a molten metal flow rate at actual casting corresponding to the quality parameters, and the prescribed qualities satisfied when the inequalities are true. The quality judging parameters are shown in the left column of the table and a filling time, a gate velocity, an injection velocity, and an air vent velocity are used in the present embodiment. The inequalities modified from the inequalities to restrict the quality judging parameters (the inequalities shown in the center column in FIG. 11) so as to restrict the square value of a molten metal flow rate at actual casting are shown in the center column. Further, the right-hand sides of the inequalities represent the judging standard values to restrict the square value of a molten metal flow rate at actual casting respectively. The prescribed qualities satisfied when the inequalities in the center column are true are shown in the right column respectively.

FIG. 2 is a table showing the expressions to obtain the upper limits and the lower limits (namely, the judging standard values to restrict the square value of a molten metal flow rate at actual casting) in the center column of the table shown in FIG. 1. The judging standard values to restrict the square value of a molten metal flow rate at actual casting are obtained by using the expressions shown in the table.

Figure 13:
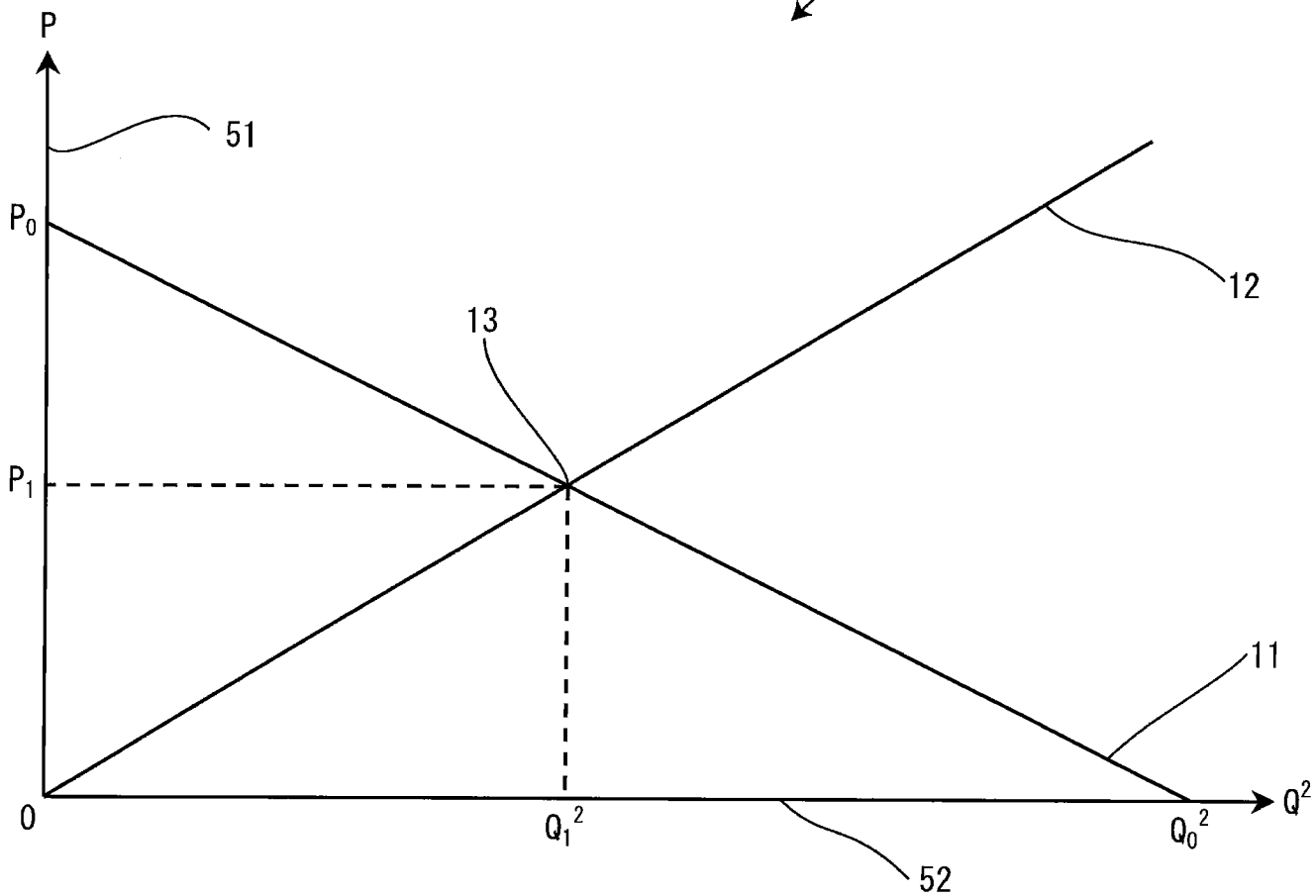
FIG. 13 is a graph showing an example of a P-$Q^2$ diagram.

At Step S140, a P-$Q^2$ diagram (refer to FIG. 13) is drawn and the processing proceeds to Step S150. At Step S150, the coordinate value on the horizontal axis of a process point that is the intersection of a machine characteristic line and a die characteristic line in the P-$Q^2$ diagram drawn at Step S140 is obtained and the processing proceeds to Step S160. Here, the coordinate value of a process point on the horizontal axis represents the square value of a molten metal flow rate at actual casting.

At Step S160, whether or not the inequalities to restrict the square value of a molten metal flow rate at actual casting are true is judged and the processing ends. More specifically, whether or not the inequalities in the center column shown in FIG. 1 are true is judged by using the square value ($Q_1^2$) of a molten metal flow rate at actual casting obtained at Step S150 and the judging standard values ($Q_{fLB}^2$, $Q_{gLB}^2$, $Q_{gUB}^2$, $Q_{sUB}^2$, and $Q_{aUB}^2$) obtained at Step S130.

By applying such processing, it is possible to: judge whether or not the inequalities to restrict the square value of a molten metal flow rate at actual casting are true; hence judge whether or not inequalities to restrict quality judging parameters are true; and judge whether or not prescribed qualities are satisfied.

Embodiment 2

Figure 8:
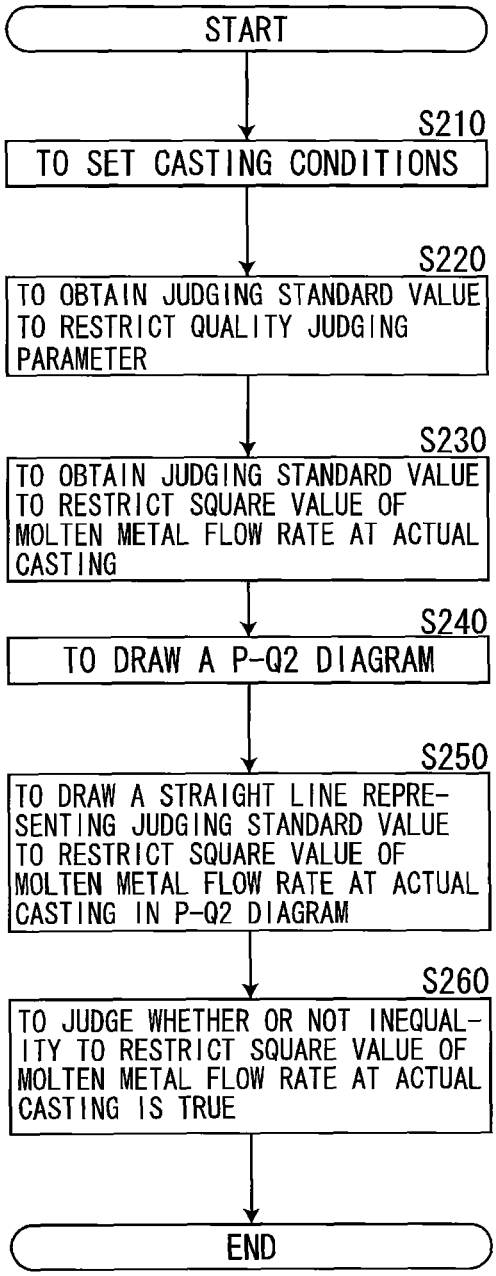
FIG. 8 is a flowchart showing the process flow of a die-cast evaluation method in Embodiment 2 according to the present invention.

FIG. 8 is a flowchart showing the process flow of the present embodiment. The steps of Step S210 to Step S240 are identical to the steps of Step S110 to Step S140 in FIG. 7 (Embodiment 1) respectively and hence the explanations are omitted.

Figure 5:
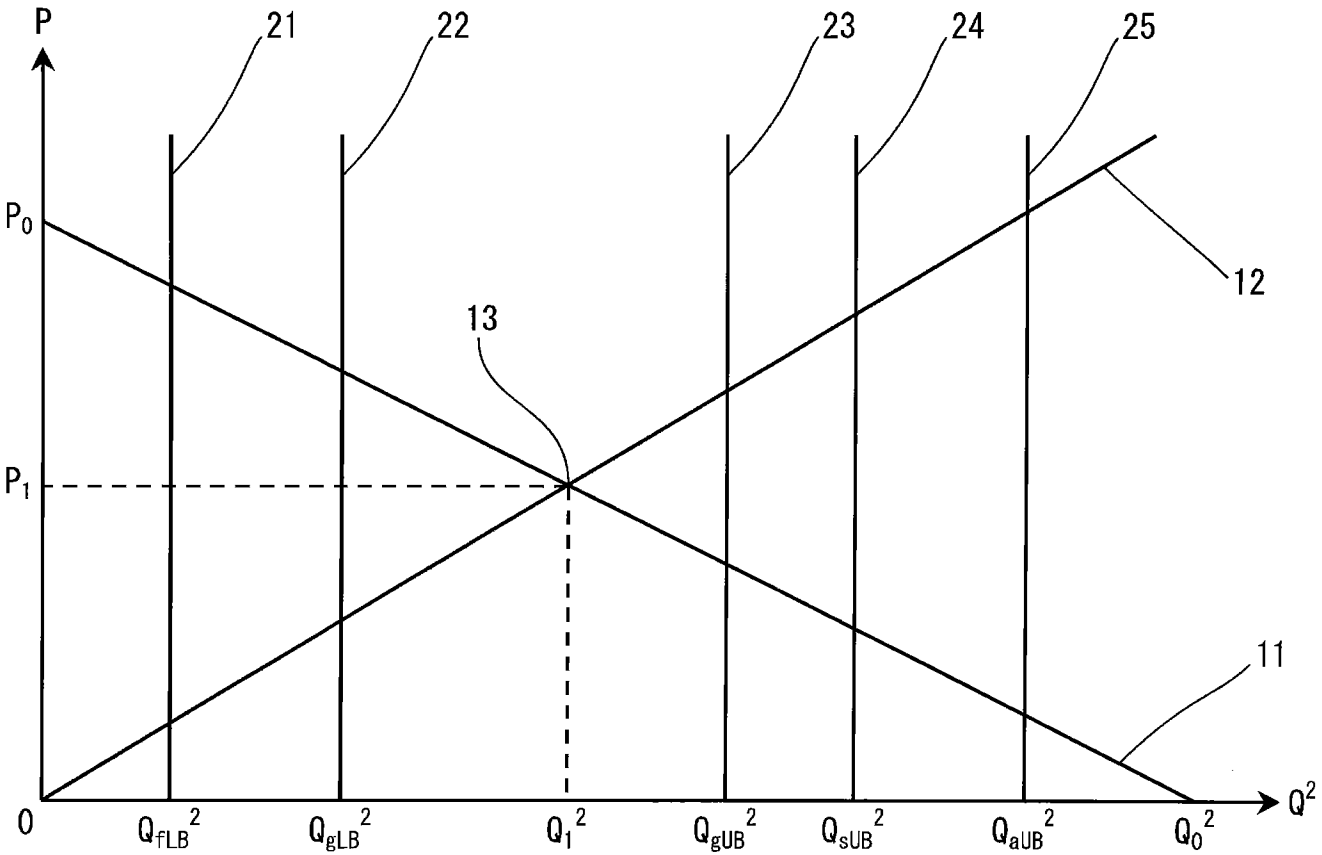
FIG. 5 is a P-$Q^2$ diagram in Embodiments 2 and 3 according to the present invention.
Figure 6:
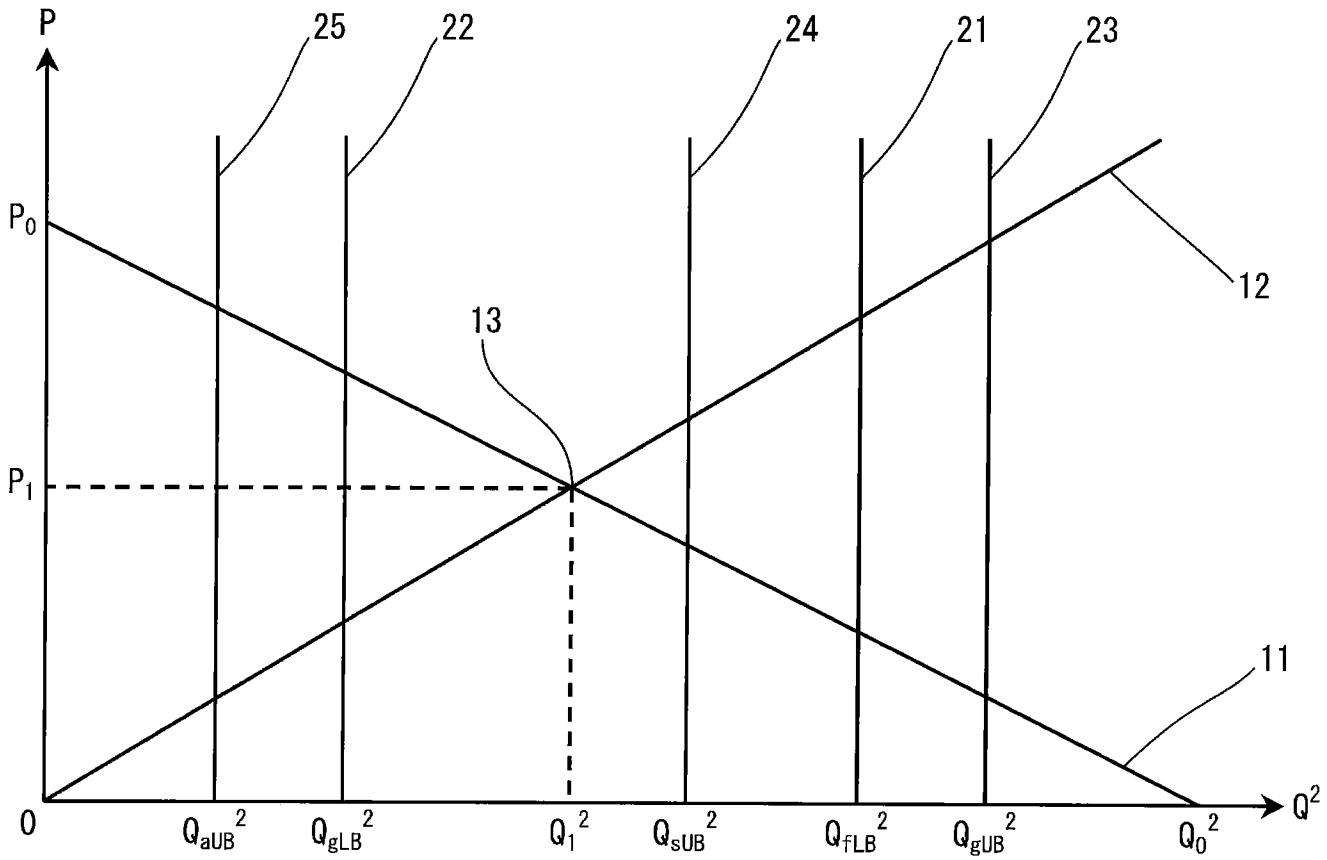
FIG. 6 is a P-$Q^2$ diagram in Embodiments 2 and 3 according to the present invention.

At Step S250, straight lines representing judging standard values to restrict the square value of a molten metal flow rate at actual casting are drawn in a P-$Q^2$ diagram drawn at Step S240 and the processing proceeds to Step S260. FIGS. 5 and 6 are graphs showing P-$Q^2$ diagrams in which judging standard values are drawn respectively. Here, symbols 21, 22, 23, 24, and 25 are straight lines representing the judging standard values $Q_{fLB}^2$, $Q_{gLB}^2$, $Q_{gUB}^2$, $Q_{sUB}^2$, and $Q_{aUB}^2$ in the inequalities shown in the center column of the table shown in FIG. 1 respectively. Further, the coordinate value on the horizontal axis of a process point 13 that is the intersection of a machine characteristic line 11 and a die characteristic line 12 represents the square value of a molten metal flow rate at actual casting.

At Step S260, whether or not the inequalities to restrict the square value of a molten metal flow rate at actual casting are true is judged and the processing ends. In FIG. 5, from the positional relation between the process point 13 and the straight lines 21, 22, 23, 24, and 25, it is judged that all the inequalities (the inequalities to restrict the square value of a molten metal flow rate at actual casting) shown in the center column of the table shown in FIG. 1 are true. That is, it is judged that all the prescribed qualities are satisfied.

Meanwhile, in FIG. 6, from the positional relation between the process point 13 and the straight lines 21, 22, 23, 24, and 25, it is judged that the inequalities ($Q_1^2 \geq Q_{fLB}^2$ and $Q_1^2 \leq Q_{aUB}^2$) restricted by the judging standard values $Q_{fLB}^2$ and $Q_{aUB}^2$ are not true and that the inequalities ($T_f \leq T_{fUB}$ and $V_a \leq V_{aUB}$) to restrict the upper limit of a filling time and the upper limit of an air vent exhaust velocity are not true. That is, it is judged that the prescribed qualities on misrun and gas inclusion are not satisfied.

By applying such processing, it is possible to: judge whether or not the inequalities to restrict the square value of a molten metal flow rate at actual casting are true; hence judge whether or not inequalities to restrict quality judging parameters are true; and judge whether or not prescribed qualities are satisfied.

Embodiment 3

Figure 9:
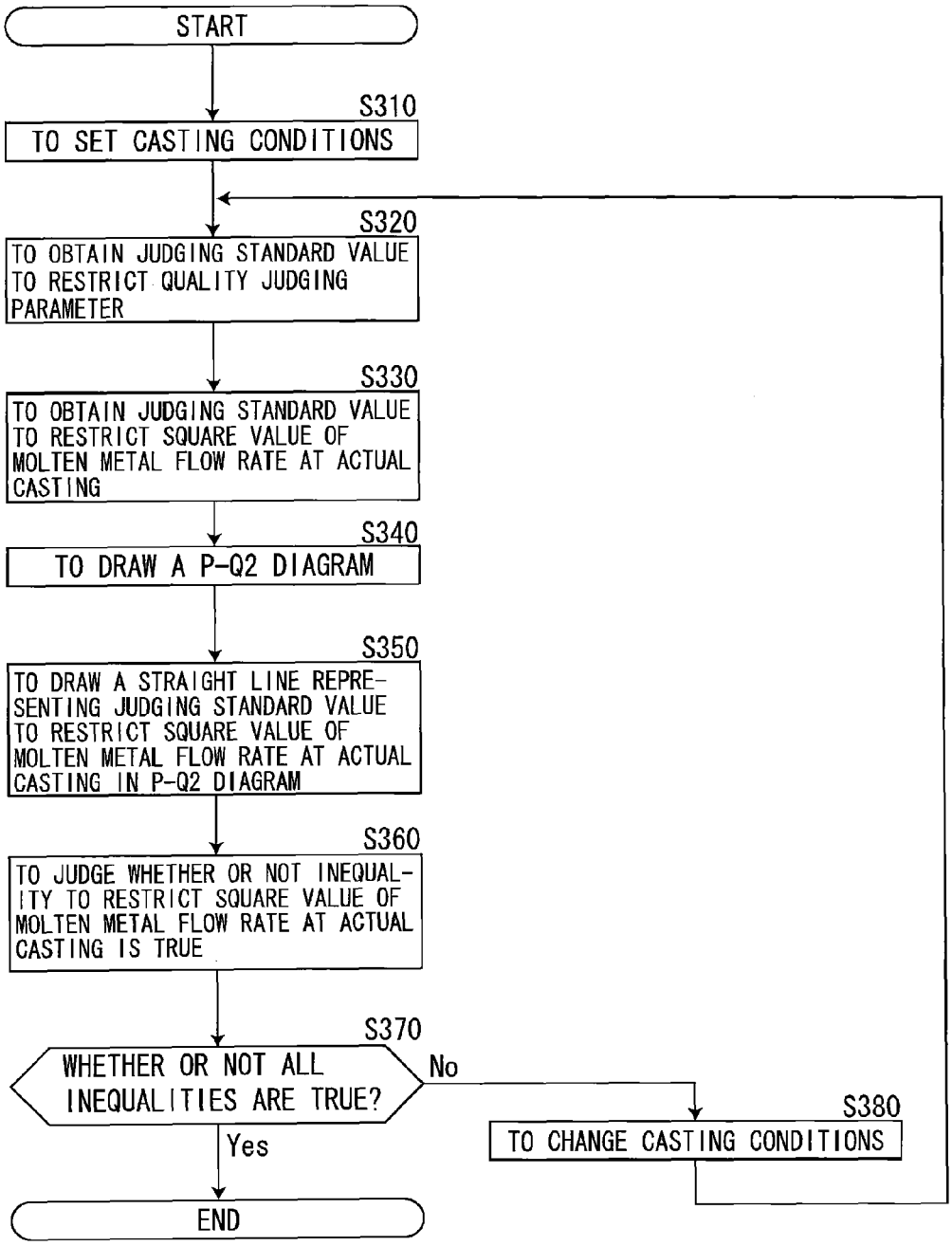
FIG. 9 is a flowchart showing the process flow of a die-casting condition determining method in Embodiment 3 according to the present invention.

FIG. 9 is a flowchart showing the process flow of the present embodiment. The steps of Step S310 to Step S360 are identical to the steps of Step S210 to Step S260 in FIG. 8 (Embodiment 2) respectively and hence the explanations are omitted.

At Step S370, from the result of the judgment at Step S360, whether or not all the inequalities are true is judged and, when all the inequalities are true, the processing ends, and if not, the processing proceeds to Step S380.

At Step S380, the die-casting conditions are changed and the processing proceeds to Step S320. FIG. 10 is a table showing the relation between inequalities and measures taken when the inequalities are not true. For example, when the inequality $Q_1^2 \geq Q_{fLB}^2$ is not true, measures such as the increase of a gate cross section $A_g$ and the like are taken.

In this way, it is possible to determine die-casting conditions by repeating the judgment of whether or not prescribed qualities are satisfied and the change of the die-casting conditions until all the inequalities become true.

Here, the method for judging a die-cast quality according to the present invention corresponds to the judgment method for quality parameters in the above Embodiments 1 to 3.

As stated above, the present invention makes it possible to provide: a die-cast quality judging method that can easily judge whether or not a prescribed quality is satisfied; a die-casting machine selecting method of judging whether or not plural prescribed qualities are satisfied by using the die-cast quality judging method; and a die-casting condition determining method of determining die-casting conditions.

Here, the processing (including judgment) in all the above embodiments either may be applied by manual operation or may be automatically computed and operated with a computer or a computer built in a die-casting machine.

Further, the straight lines representing the judging standard values in a P-$Q^2$ diagram may be drawn by changing colors. In particular, judgment becomes easier by changing colors between the case of restricting the upper limit and the case of restricting the lower limit of the square value of a molten metal flow rate at actual casting.

The invention claimed is:

1. A die-cast quality judging method of judging whether or not a die-casting product cast under set die-casting conditions satisfies a prescribed quality on the basis of whether or not a first inequality $Z \geq Z_B$ to restrict the value of a quality judging parameter Z by a first judging standard value $Z_B$ functioning as a standard for judging whether or not the prescribed quality is satisfied is true, wherein when the quality judging parameter Z is represented by an expression $Z=F(Q_1)$ by using a function F of a molten metal flow rate $Q_1$ at actual casting, the first inequality $Z \geq Z_B$ becomes an expression $F(Q_1) \geq Z_B$, whether or not the prescribed quality is satisfied is judged on the basis of whether or not a second inequality $Q_1^2 \geq Q_{fLB}^2$ modified so as to restrict a square value of a molten metal flow rate $Q_1^2$ at actual casting by a second judging standard value $Q_{fLB}^2$ is true, wherein the quality judging parameter is a filling time $T_f$; and, when a first inequality $T_f \leq T_{fUB}$ to restrict a value of the filling time $T_f$ by a first judging standard value $T_{fUB}$ functioning as a standard for judging whether or not the prescribed quality is satisfied is given, a value obtained by dividing a filling volume $V_f$ in the set die-casting conditions by the first judging standard value $T_{fUB}$ to restrict the value of the filling time $T_f$ and squaring the divided value is used as the second judging standard value $Q_{fLB}^2$ to restrict the square value of a molten metal flow rate at actual casting in the second inequality $Q_1^2 \geq Q_{fLB}^2$.

2. A die-cast quality judging method of judging whether or not a die-casting product cast under set die-casting conditions satisfies a prescribed quality on the basis of whether or not a first inequality $Z \geq Z_B$ to restrict the value of a quality judging parameter Z by a first judging standard value $Z_B$ functioning as a standard for judging whether or not the prescribed quality is satisfied is true, wherein when the quality judging parameter Z is represented by an expression $Z=F(Q_1)$ by using a function F of a molten metal flow rate $Q_1$ at actual casting, the first inequality $Z \geq Z_B$ becomes an expression $F(Q_1) \geq Z_B$, whether or not the prescribed quality is satisfied is judged on the basis of whether or not a second inequality $Q_1^2 \geq Q_{gLB}^2$ or $Q_1^2 \leq Q_{gUB}^2$ modified so as to restrict a square value of a molten metal flow rate $Q_1^2$ at actual casting by a second judging standard value $Q_{gLB}^2$ or $Q_{gUB}^2$ is true, wherein the quality judging parameter is a gate velocity $V_g$; and, when a first inequality $V_g \geq V_{gLB}$ or $V_g \leq V_{gUB}$ to restrict a value of the gate velocity $V_g$ by a first judging standard value $V_{gLB}$ or $V_{gUB}$ functioning as a standard for judging whether or not the prescribed quality is satisfied is given, a value obtained by multiplying the first judging standard value $V_{gLB}$ or $V_{gUB}$ to restrict the value of the gate velocity $V_g$ by a gate cross section in the set die-casting conditions and squaring the multiplied value is used as the second judging standard value $Q_{gLB}^2$ or $Q_{gUB}^2$ to restrict the square value of a molten metal flow rate at actual casting in the second inequality $Q_1^2 \geq Q_{gLB}^2$ or $Q_1^2 \leq Q_{gUB}^2$.

3. A die-cast quality judging method of judging whether or not a die-casting product cast under set die-casting conditions satisfies a prescribed quality on the basis of whether or not a first inequality $Z \geq Z_B$ to restrict the value of a quality judging parameter Z by a first judging standard value $Z_B$ functioning as a standard for judging whether or not the prescribed quality is satisfied is true, wherein when the quality judging parameter Z is represented by an expression $Z=F(Q_1)$ by using a function F of a molten metal flow rate $Q_1$ at actual casting, the first inequality $Z \geq Z_B$ becomes an expression $F(Q_1) \geq Z_B$ whether or not the prescribed quality is satisfied is judged on the basis of whether or not a second inequality $Q_1^2 \leq Q_{sUB}^2$ modified so as to restrict a square value of a molten metal flow rate $Q_1^2$ at actual casting by a second judging standard value $Q_{sUB}^2$ is true, wherein the quality judging parameter is a fin forming injection velocity $V_s$; and, when a first inequality $V_s \leq V_{sUB}$ to restrict a value of the fin forming injection velocity $V_s$ by a first judging standard value $V_{sUB}$ functioning as a standard for judging whether or not the prescribed quality is satisfied is given, a value obtained by multiplying the first judging standard value $V_{sUB}$ to restrict the value of the injection velocity $V_s$ by a sleeve cross section in the set die-casting conditions and squaring the multiplied value is used as the second judging standard value $Q_{sUB}^2$ to restrict the square value of a molten metal flow rate at actual casting in the second inequality $Q_1^2 \leq Q_{sUB}^2$.

4. A die-cast quality judging method of judging whether or not a die-casting product cast under set die-casting conditions satisfies a prescribed quality on the basis of whether or not a first inequality $Z \geq Z_B$ to restrict the value of a quality judging parameter Z by a first judging standard value $Z_B$ functioning as a standard for judging whether or not the prescribed quality is satisfied is true, wherein when the quality judging parameter Z is represented by an expression $Z=F(Q_1)$ by using a function F of a molten metal flow rate $Q_1$ at actual casting, the first inequality $Z \geq Z_B$ becomes an expression $F(Q_1) \geq Z_B$ whether or not the prescribed quality is satisfied is judged on the basis of whether or not a second inequality $Q_1^2 \leq Q_{aUB}^2$ modified so as to restrict a square value of a molten metal flow rate $Q_1^2$ at actual casting by a second judging standard value $Q_{aUB}^2$ is true, wherein the quality judging parameter is an air vent exhaust velocity $V_a$; and, when a first inequality $V_a \leq V_{aUB}$ to restrict a value of the air vent exhaust velocity $V_a$ by a first judging standard value $V_{aUB}$ functioning as a standard for judging whether or not the prescribed quality is satisfied is given, a value obtained by multiplying the first judging standard value $V_{aUB}$ to restrict the value of the air vent exhaust velocity $V_a$ by an air vent cross section in the set die-casting conditions and squaring the multiplied value is used as the second judging standard value $Q_{aUB}^2$ to restrict the square value of a molten metal flow rate at actual casting in second inequality $Q_1^2 \leq Q_{aUB}^2$.

5. The die-cast quality judging method according to any one of claim 1, 2, 3, or 4, wherein the coordinate value on the horizontal axis of a process point that is an intersection of a machine characteristic line and a die characteristic line in a $P\text{-}Q^2$ diagram under the set die-casting conditions is set so as to be the square value of a molten metal flow rate at actual casting.

6. The die-cast quality judging method according to any one of claim 1, 2, 3, or 4, wherein a straight line representing the second judging standard value to restrict the square value of a molten metal flow rate at actual casting in the second inequality is drawn in a $P\text{-}Q^2$ diagram under the set die-casting conditions; two divided regions are formed in the $P\text{-}Q^2$ diagram by using the straight line representing the second judging standard value as a border line; and whether or not the prescribed quality is satisfied is judged on the basis of the region in which the process point that is the intersection of a machine characteristic line and a die characteristic line in the $P\text{-}Q^2$ diagram is located.

* * * * *